US005984409A

United States Patent [19]

Eakin et al.

[11] Patent Number: 5,984,409

[45] Date of Patent: Nov. 16, 1999

[54] RECLINING CHAIR ASSEMBLY

[75] Inventors: Byron C. Eakin, Tampa; Kenneth Schuck, Indian Rock Beach, both of Fla.

[73] Assignee: Somatron Corporation, Tampa, Fla.

[21] Appl. No.: 09/058,601

[22] Filed: Apr. 10, 1998

[51] Int. Cl.[6] ..... A47C 1/02; A61G 15/06

[52] U.S. Cl. ..... 297/327; 297/326; 297/281; 297/282

[58] Field of Search ..... 297/327, 281, 297/282, 270, 326, 329

[56] References Cited

U.S. PATENT DOCUMENTS

| | | | |
|---|---|---|---|
| Re. 7,223 | 7/1876 | White | 297/327 |
| Re. 8,380 | 8/1878 | White et al. | 297/327 |
| 13,396 | 8/1855 | Perkins | 297/327 |
| D. 181,048 | 9/1957 | Golden | 297/327 X |
| 281,124 | 7/1883 | Ordway | 297/326 X |
| 289,743 | 12/1883 | Young | 297/282 |
| 374,628 | 12/1887 | Pynchon | 297/329 |
| 513,584 | 1/1894 | Leisenring | 297/327 X |
| 659,216 | 10/1900 | Dowling et al. | 297/327 X |
| 766,836 | 8/1904 | Miller et al. | 297/282 |
| 1,231,686 | 7/1917 | Zuniga | 297/281 X |
| 2,036,529 | 4/1936 | Kindelberger et al. | 297/327 |
| 2,448,860 | 9/1948 | Collins | 297/327 X |
| 3,235,304 | 2/1966 | Glass | 297/327 X |
| 4,341,420 | 7/1982 | Knowles et al. | 297/281 X |
| 4,707,026 | 11/1987 | Johansson | 297/281 |
| 4,790,599 | 12/1988 | Goldman | 297/327 |
| 4,893,827 | 1/1990 | Gay et al. | 297/327 X |
| 5,005,905 | 4/1991 | Sondergedl | 297/281 X |
| 5,131,717 | 7/1992 | Kaminiski et al. | 297/327 X |
| 5,498,055 | 3/1996 | Goldman | 297/282 X |

*Primary Examiner*—Jose V. Chen
*Assistant Examiner*—Rodney B. White

[57] ABSTRACT

A brake assembly to selectively allow or restrict a pivotal movement of a seat frame relative to a base frame in a reclining chair assembly is disclosed. Reclining chair assemblies applicable to the present invention have a back support member and a seat support member of the seat frame which are positionally fixed during usage of the reclining chair assembly. The seat frame moves relative to the base frame at a pivotal axis common to the base frame and the seat frame. The brake assembly attaches to the seat frame and the base frame to provide for control over the pivotal movement therebetween. In a preferred embodiment opposing arm rests of the reclining chair assembly are positionally fixed relative to the base frame. A first embodiment of the brake assembly relies upon an anchoring of positional orientations of an anchor point relative to a pivotal point. The anchor point and the pivotal point are positioned on opposing frame members, being the base frame and the seat frame, wherein a variable spacing exists between the two points during pivotal movement of the seat frame relative to the base frame. A second embodiment of the brake assembly relies upon an anchoring of a locking member fixedly positioned on the base frame relative to an arced guide member positioned on the seat frame.

12 Claims, 9 Drawing Sheets

54
52
10
116
40
121
56
58
92
57
120

RECLINING CHAIR ASSEMBLY

BACKGROUND

1. Field of the Invention

Generally, the invention relates to reclining chair assemblies. More specifically, the invention relates to such assemblies having means to control and positionally lock a reclining action of a seat frame relative to a base frame about a single pivotal axis common to the two frames.

2. Description of the Prior Art

Reclining chairs applicable to the present invention have a seat frame comprising a seat support portion and a back support portion which are positionally fixed relative to each other during usage. Such reclining chairs may also having a leg support portion positioned on, or relative to, the seat frame. Applicable reclining chairs have the seat frame mounted on a base frame wherein the seat frame may pivot at a pivotal axis common to both the seat frame and the base frame. The base frame rests on a support surface, such as a floor, during usage.

Such reclining chairs are known in the art including various methods of selectively locking the seat frame relative to the base frame at a desired angular orientation. Various attempts have been made to provide for the selective locking of the seat frame relative to the base frame at a desired positional location. These attempts have been less efficient than desired. Typically, these attempts have relied upon operator controlled mechanisms which move concurrently with the seat frame which makes for inconvenient operation by the seated operator. As such, it may be appreciated that there continues to be a need for a convenient method of selectively locking the seat frame relative to the base frame. The present invention substantially fulfills these needs.

SUMMARY

In view of the foregoing disadvantages inherent in the known types of positional locking methods for reclining chairs, your applicants have devised a method of locking a seat frame at a desired positional location relative to a base frame. A reclining chair assembly comprising a base frame, a seat frame, pivotal connection means and a brake assembly cooperate to fulfill this method. The base frame provides for contact with a support surface as exampled by a floor. The seat frame provides for support of a cushion member, or members. The seat frame has a back support member and a seat support member which have a fixed relative positional orientation during usage of the reclining chair. The pivotal connection means provides for a mounting of the seat frame relative to the base frame wherein a pivotal movement of the seat frame relative to the base frame at a pivotal axis may occur. The brake assembly provides for an anchoring of the seat frame relative to the base frame at a desired angular orientation. The brake assembly comprises an engagement member and a locking member. The engagement member connects to both the seat frame and the locking member. The locking member has a locked state and an unlocked state and provides for a securing of the engagement member at a desired position relative to the base frame while in the locked state. This provides for the seat frame to be retained at the desired angular orientation relative to the base frame while the locking member is in the locked state.

Our invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for selectively locking a seating frame of a reclining chair assembly at a desired angular orientation relative to a base frame of the reclining chair assembly.

Other objects include;

a) to provide for an operator control member to have a fixed position relative to the base frame.

b) to provide for a pivotal axis common to the base frame and the seat frame.

c) to provide for a pivotal point of a brake assembly to be positioned on either the base frame or the seat frame.

d) to provide for an anchor point of the brake assembly to be positioned on the opposing base frame or seat frame from the pivotal point of the brake assembly.

e) to provide for a coupling member of the brake assembly to connect the pivotal point and the anchor point wherein the pivotal point and the anchor point each have a unique spacing from the pivotal axis common to the seat frame and the base frame.

f) to provide for opposing arm rests to be positionally fixed relative to the base frame.

g) to provide for containment of displaceable components of the brake assembly within a confine of an arm rest side cover plate.

h) to provide for a generally vertical orientation of the coupling member of the brake assembly connecting the anchor point and the pivotal point.

i) to provide for an arced guide component to be attached to the seating frame and the linking shaft of the brake assembly to be fixedly positioned on the base frame wherein the linking shaft slidably engages the arced guide component.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 1*b* is a side elevational view of the reclining chair assembly shown in FIG. 1*a* in a seated orientation.

DESCRIPTION

Figure 1A:
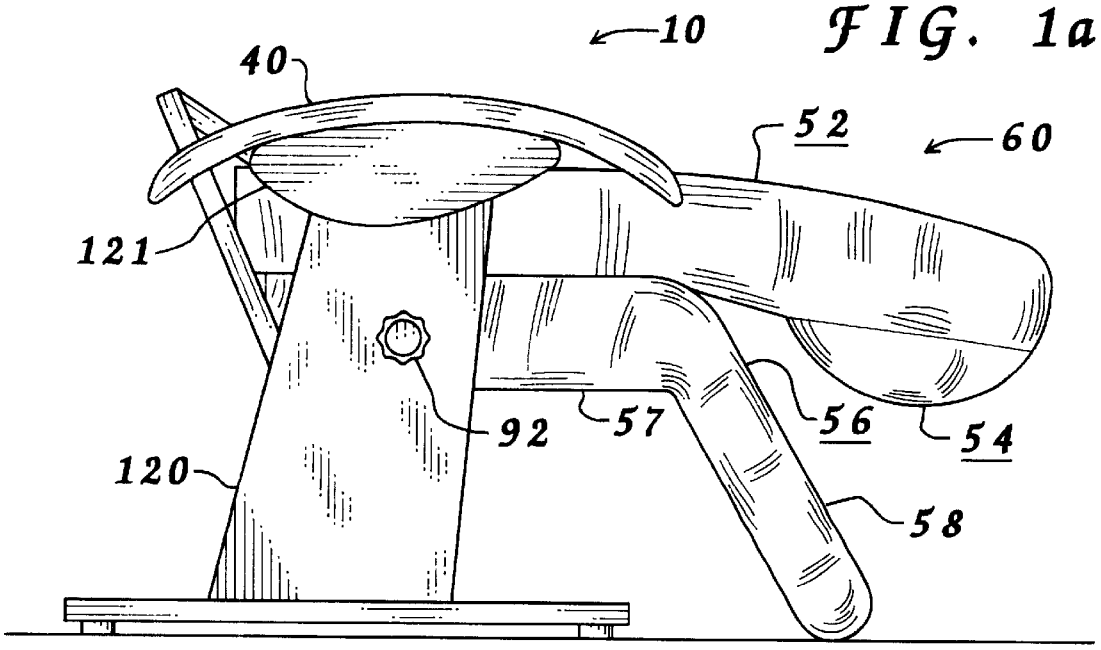
FIG. 1*a* is a side elevational view of a reclining chair assembly in a folded orientation.
Figure 16:
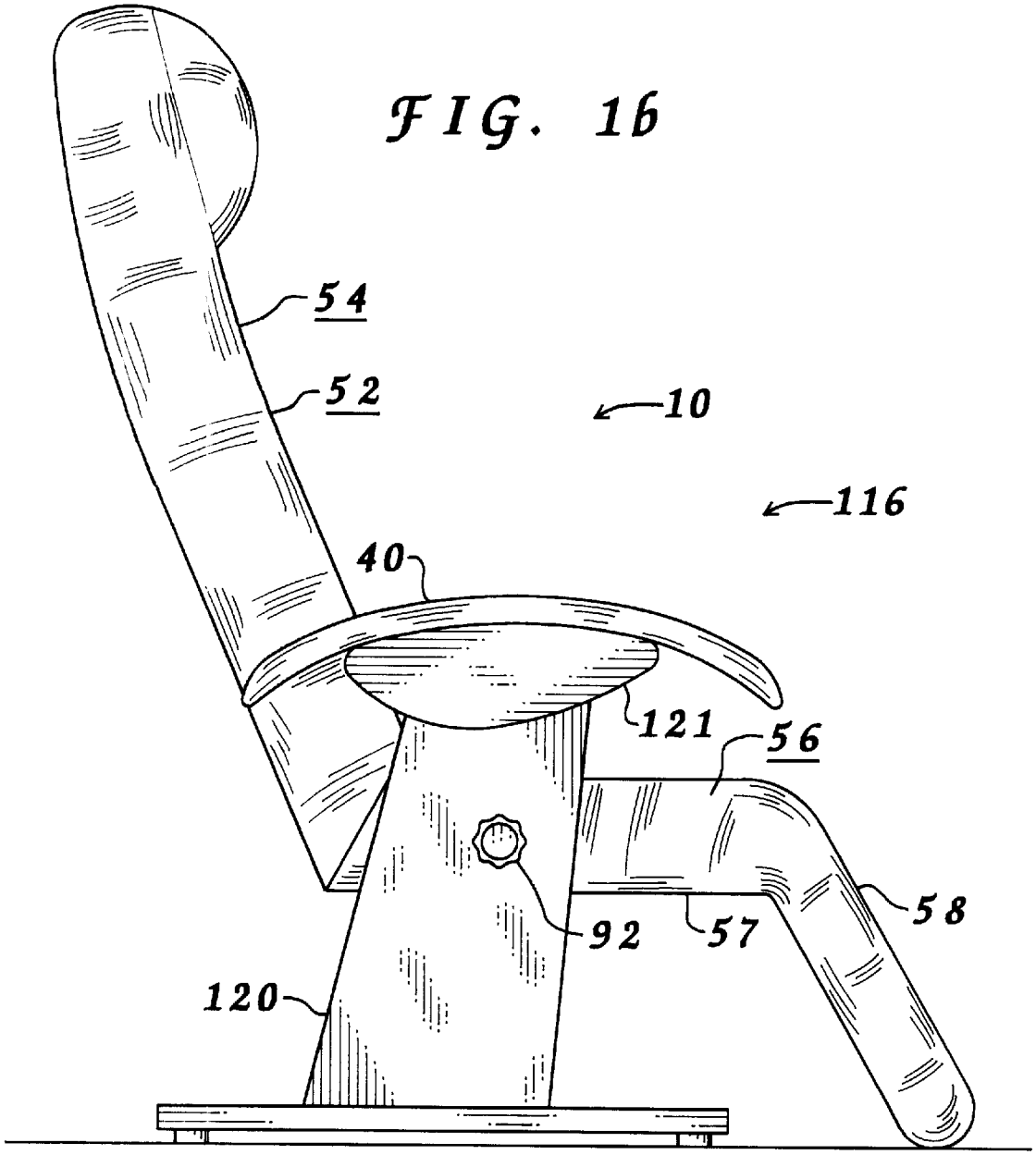

Referring now to the drawings where like reference numerals refer to like parts throughout the various views. Reclining chairs having features of the present invention will have various features in common. These features are generally listed herein. A floor contacting support assembly of sufficient distribution to provide stability to the chair during usage will be present. This will comprise a base frame having opposing spaced vertically extending members which will have a base traversing axis extending therebetween. A seat frame will have at least a seating section and a back support section which will be fixedly positioned relative to each other during usage of the chair. Optionally, a leg support section may be attached to the seat frame distal from the back support section. The leg support section may be fixedly positioned relative to the seating section or may be attached for pivotal movement on the seat frame. The seat frame will have a seat traversing axis extending thereacross in close proximity to a center of balance of the seat frame when a cushion assembly and a user are resting thereon. These traversing axises will be utilized to connect the seat frame to the base frame at a pivotal axis for pivotal movement of the seat frame relative to the stationary base frame. The present invention relates to structures, and associative methods, of anchoring the seat frame at a desired angular orientation relative to the base frame within this pivotal movement.

Figure 1C:
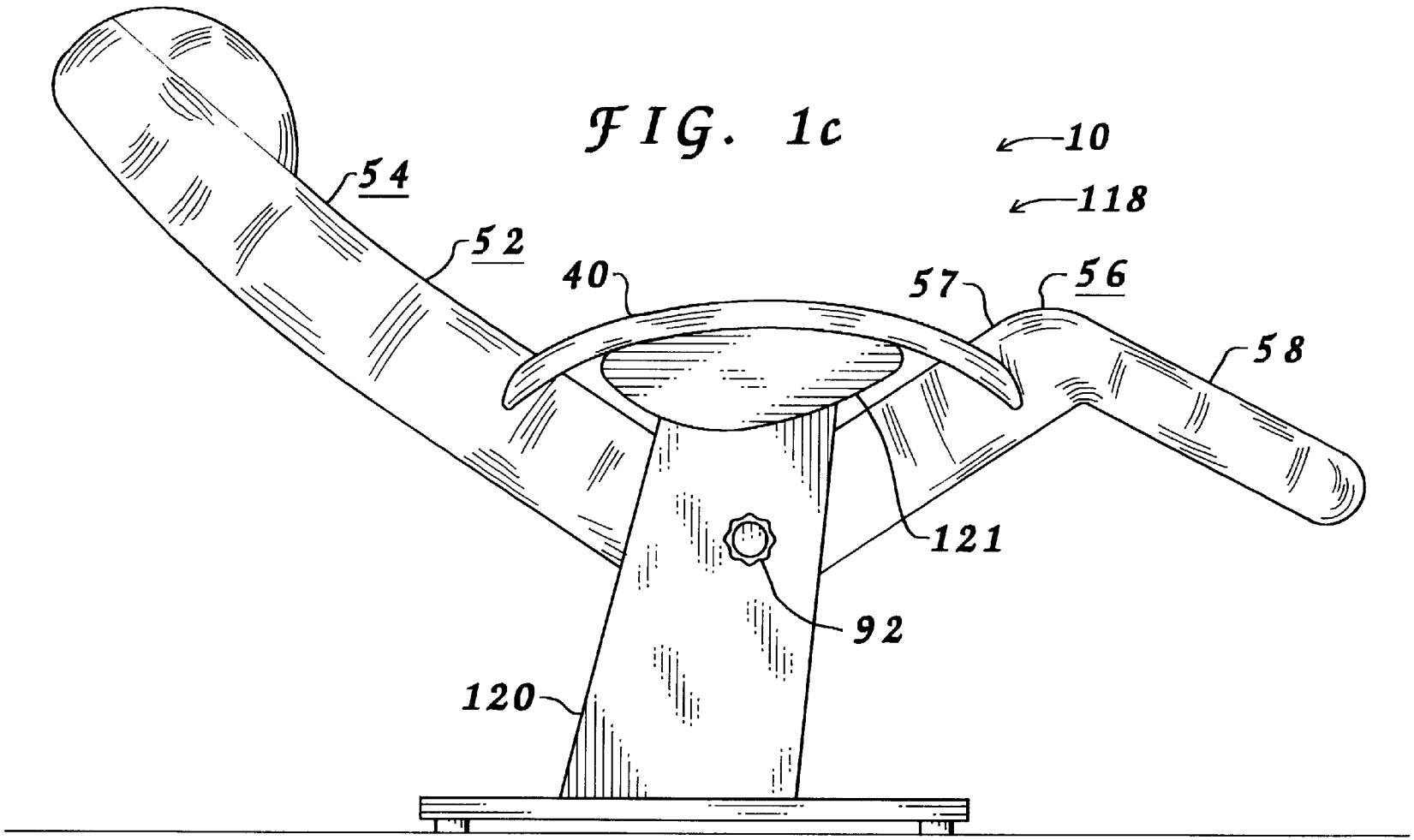
FIG. 1*c* is a side elevational view of the reclining chair assembly shown in FIG. 1*a* and 1*b* in a reclined orientation.
Figure 2:
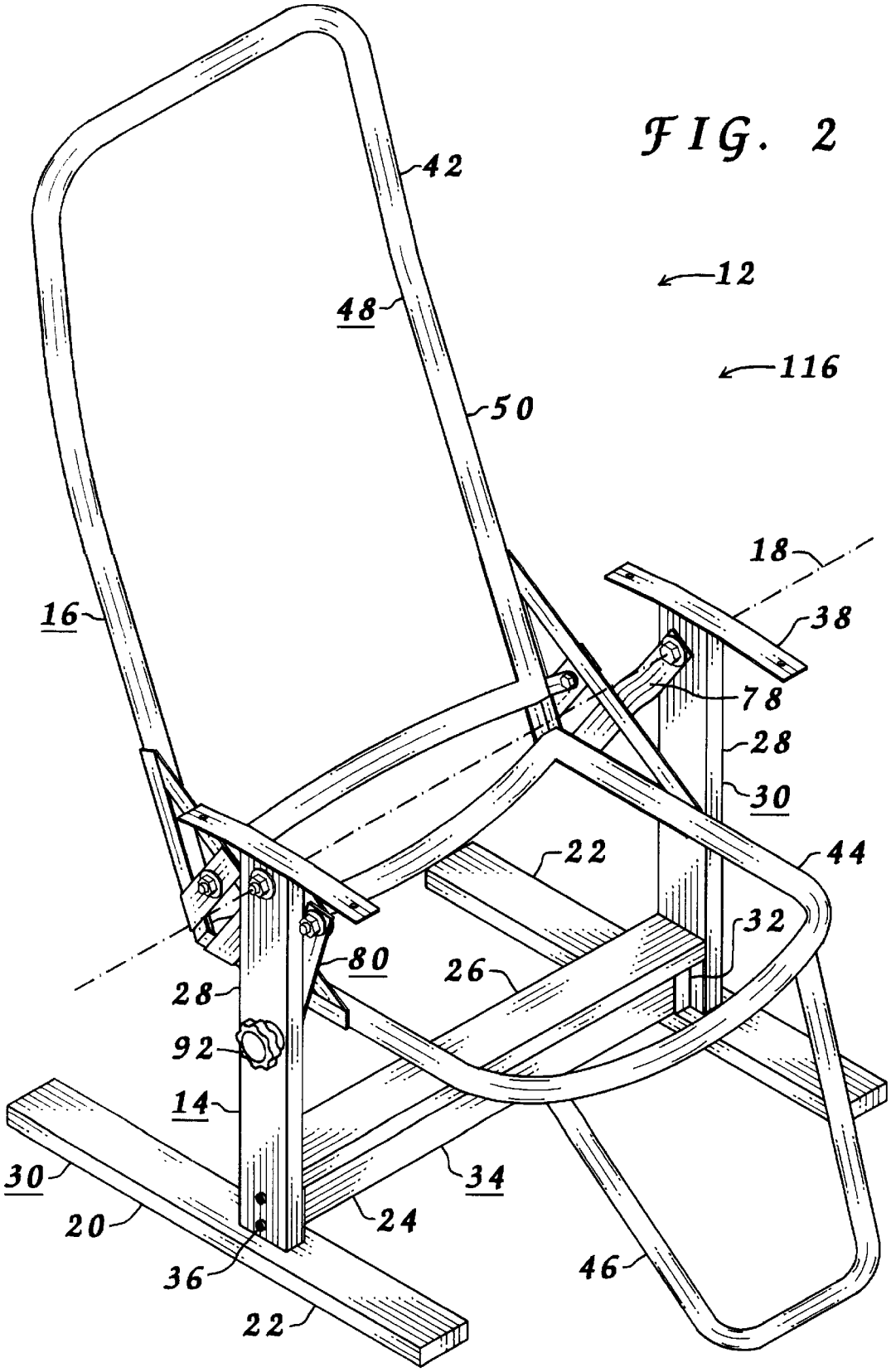
FIG. 2 is a perspective view of a frame assembly utilized in the reclining chair assembly shown in FIG. 1*a* through FIG. 1*c* while in the seated orientation shown in FIG. 1*b*.

Specifically referring now to FIG. 1*a* through FIG. 4, a reclining chair assembly 10, or portions taken therefrom, is depicted. FIG. 2 clearly depicts construction of a frame assembly 12 which comprises a portion of reclining chair assembly 10, shown in FIG. 1*a* through FIG. 1*c*. Frame assembly 12 comprises a base frame 14 and a seat frame 16 which are connected at a pivotal axis 18.

Base frame 14 may be constructed of various materials formed into various cross section shapes. Components may be linear, as utilized for the preferred embodiment depicted in the various views, or may have a curvature thereon including compound curvatures. A particularly expedient construction material to form base frame 14 from is a rectangularly shaped tubing 20 of a rigid construction. Such construction providing superior strength qualities to the resultant frame. Base frame 14 comprises opposing extensions 22 which distribute support of reclining chair assembly 10 over a sufficient ground contacting surface to provide adequate stability to reclining chair assembly 10 during usage. Connecting the opposing extensions 22 is a lower brace 24, vertically oriented along the greater width and resting on each extension 22. An upper brace 26, horizontally oriented along the greater width and resting upon lower brace 24, may be included to enhance structural integrity. Such enhancement is particularly expedient when transportable disassembly, detailed elsewhere herein, is provided. Extending upward from each extension 22, and contacting lower brace 24 and upper brace 26 at their respective distal ends, is a coupling brace 28. Connection of extensions 22, lower brace 24, upper brace 26 and coupling braces 28 may occur by any applicable method conventionally known in the art, as exampled by welding.

In a preferred embodiment designed for transportable disassembly, each respective coupling brace 28 is rigidly attached to a respective extension 22 to form a side assembly 30. Angle brackets 32 are then rigidly attached to each side assembly 30 adjacent the location of eventual placement of lower brace 24, only forward angle bracket 32 shown. The combination of lower brace 24 and upper brace 26 form a center assembly 34. Securing members 36 may then be employed to rigidly attach the opposing side assemblies 30 to center assembly 34 with lower brace 24 held between opposing angle braces 32 on each side assembly 30. This arrangement provides for disassembly of base frame 14 into three (3) assemblies, two (2) side assemblies 30 and one (1) center assembly 34, for ready transport, more fully disclosed elsewhere herein.

Arm rest support plates 38 attach to an upper extent of each coupling brace 28 for subsequent attachment of an arm rest 40, see FIG. 1*a* through FIG. 1*c*. Preferably, opposing arm rests 40 are positionally fixed relative to base frame 14 so as to remain stationary during movement of seat frame 16 relative to base frame 14. This arrangement allows the operator, not shown in any of the views, to have a conveniently positioned hand placement area to exert a pushing or pulling force upon during movement of seat frame 16 relative to base frame 14. Pivotal axis 18 penetrates each coupling brace 28, or some other portion of base frame 14, so as to remain stationary during movement of seat frame 16 relative to base frame 14.

Seat frame 16 comprises a back support frame 42, a seat support frame 44, a leg support frame 46 and opposing coupling assemblies 48. Back support frame 42, seat support frame 44 and leg support frame 46 may be constructed of various materials formed into various cross section shapes. Components may be linear or may have a curvature thereon including compound curvatures or may be a combination of thereof as depicted in the preferred embodiment. A particularly expedient construction design involves use of a tubular shaped tubing 50 of a rigid construction. Each section of tubular shaped tubing 50 is contoured and shaped to provide for subsequent attachment thereto of strapping, as conventionally known in the art and not shown in any of the views. This combination provides for support of a cushion assembly 52, see FIG. 1*a* through FIG. 1*c*, for comfortable resting thereupon by a user, not shown in any of the views. Cushion assembly 52 comprises an upper cushion 54 and a lower cushion 56 having a seat cushion portion 57 and a leg cushion portion 58.

Preferably, upper cushion 54 contains a pocket, not shown, which receives at least a portion of back support frame 42 of seat frame 16. Preferably, lower cushion 56 similarly contains a pocket, not shown, which receives at least a portion of leg support frame 46 of seat frame 16.

These arrangements provides for a securement of cushion assembly 52 to seat frame 16 while providing for an aesthetically appealing reclining chair assembly 10. The pockets may optionally be flapped as conventionally known in the art, as exampled by being separable by a closure assembly such as a zipper. Such an arrangement provides for convenient access to seat frame 16 for manipulation of connection members, as conventionally known in the art and not shown, of cushion assembly 52 for subsequent securement relative to seat frame 16. When a vibration creation device, detailed elsewhere herein, is utilized, such access provides for convenient manipulation of any connections, not shown in any of the views.

Seat support frame 44 preferably is rigidly attached to each coupling assembly 48. Back support frame 42 may be rigidly attached to each coupling assembly 48 or, more preferably, may be pivotally attached thereto for movement into a folded position 60, see FIG. 1*a* and FIG. 3*a*. Leg support frame 46 preferably is rigidly attached to seat support frame 44. Alternatively, leg support frame 46 may be pivotally attached, not shown, to seat support frame 44 for subsequent adjustment of an angular orientation therebetween during usage.

Figure 3A:
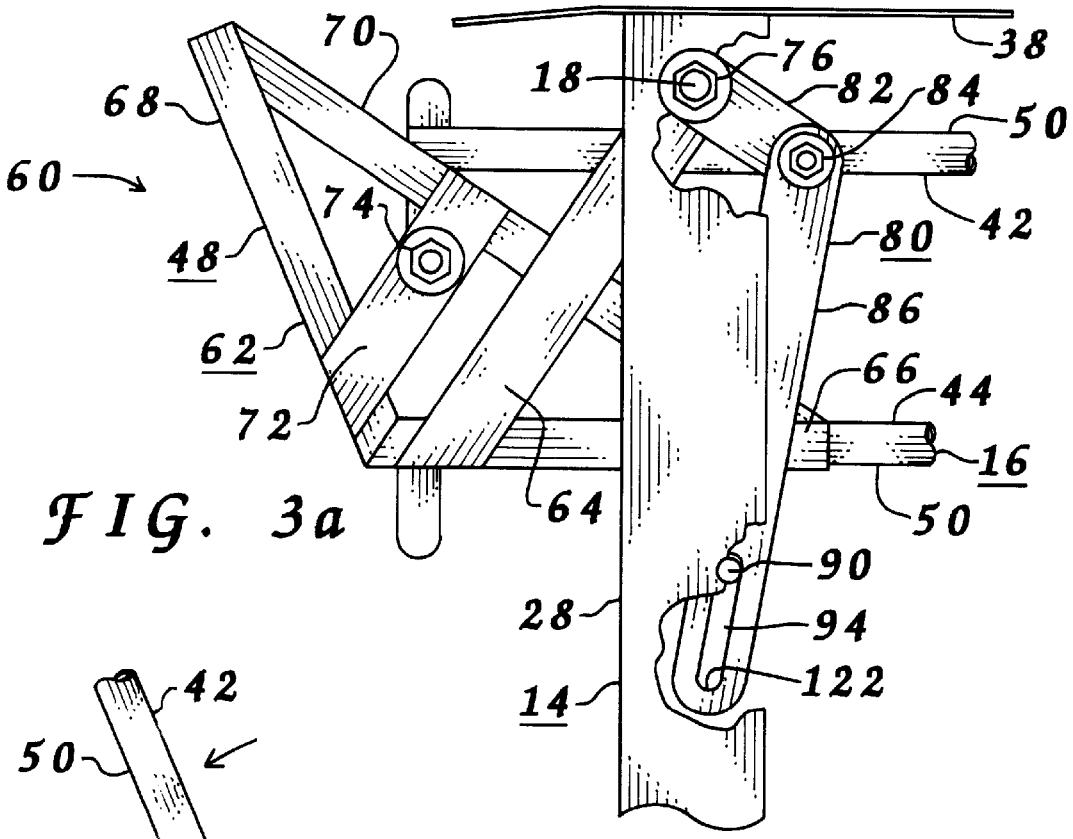
FIG. 3*a* through FIG. 3*d* are sectional side elevational views of a portion of the frame assembly depicted in FIG. 2, with sections of a coupling brace cut away to expose components positioned therebehind, while more clearly depicting a brake assembly in various positional orientations.
Figure 3B:
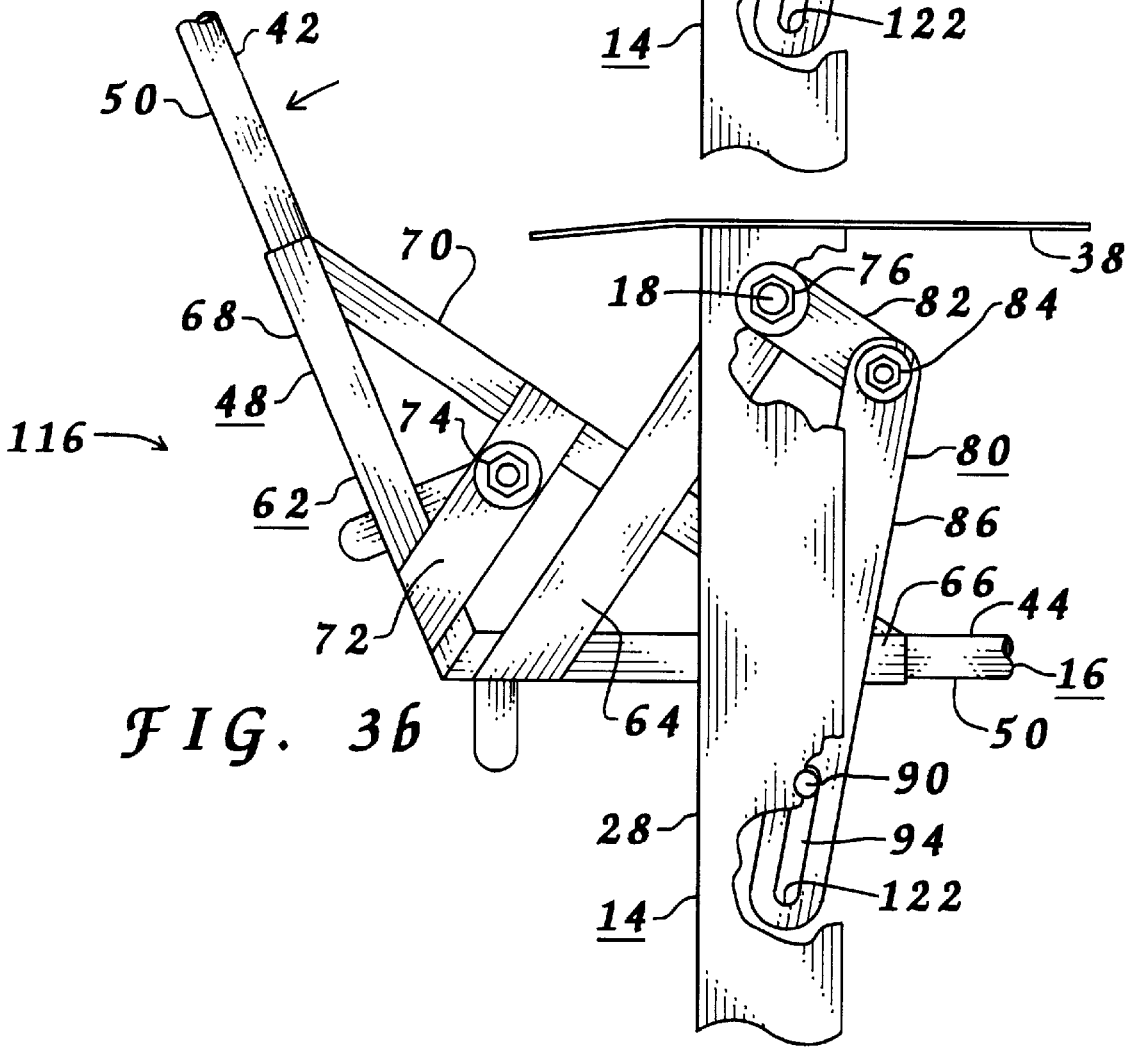
Figure 3C:
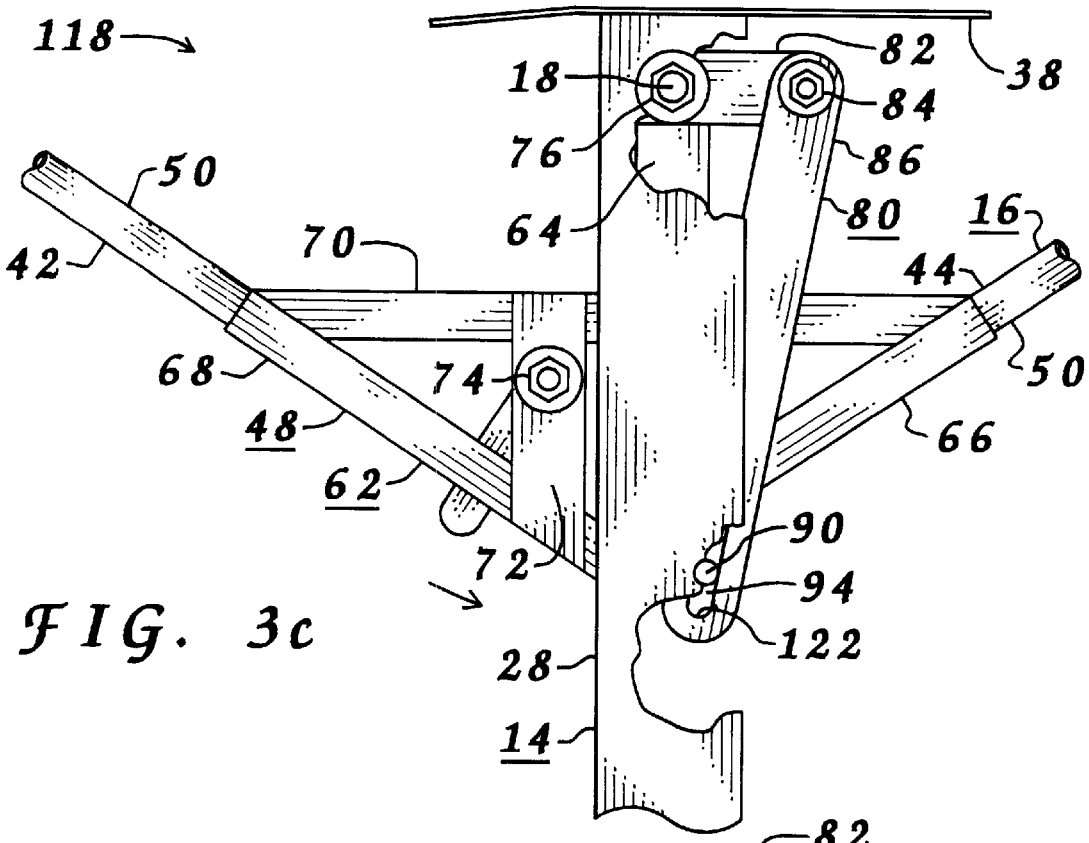
Figure 3D:
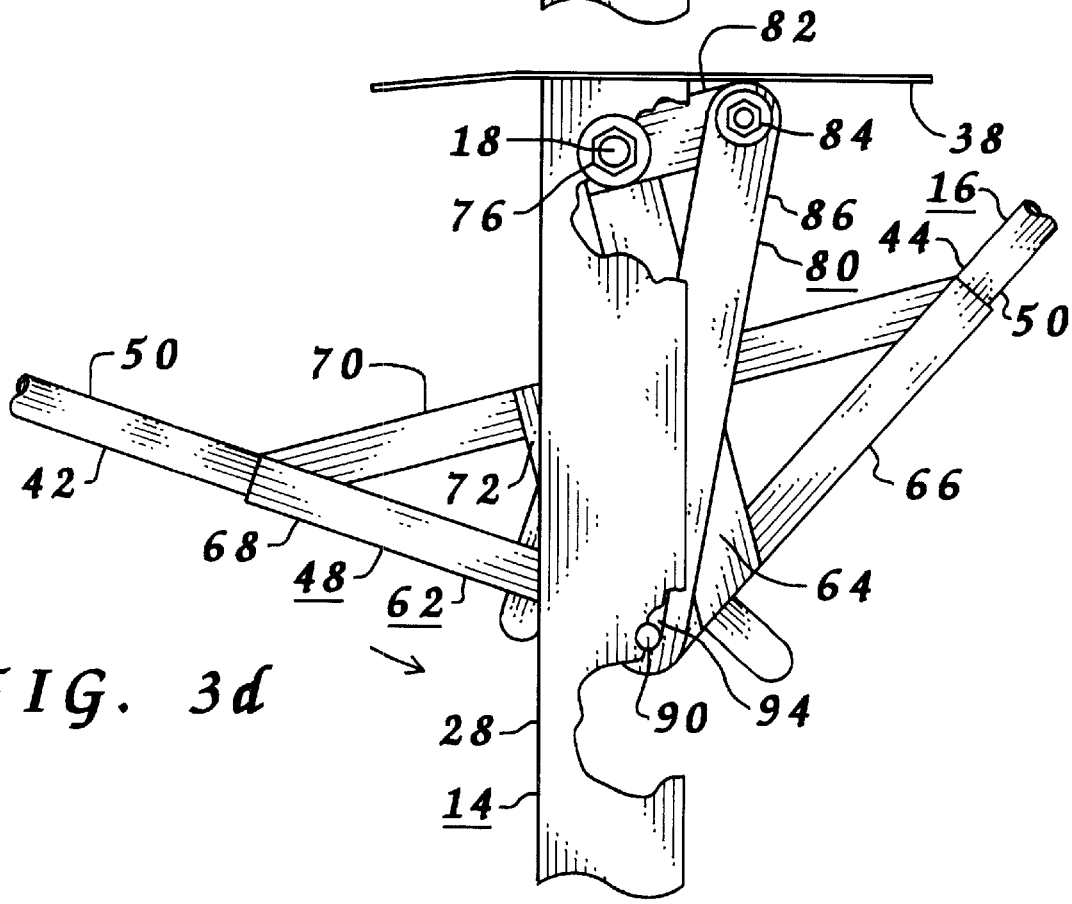
Figure 4:
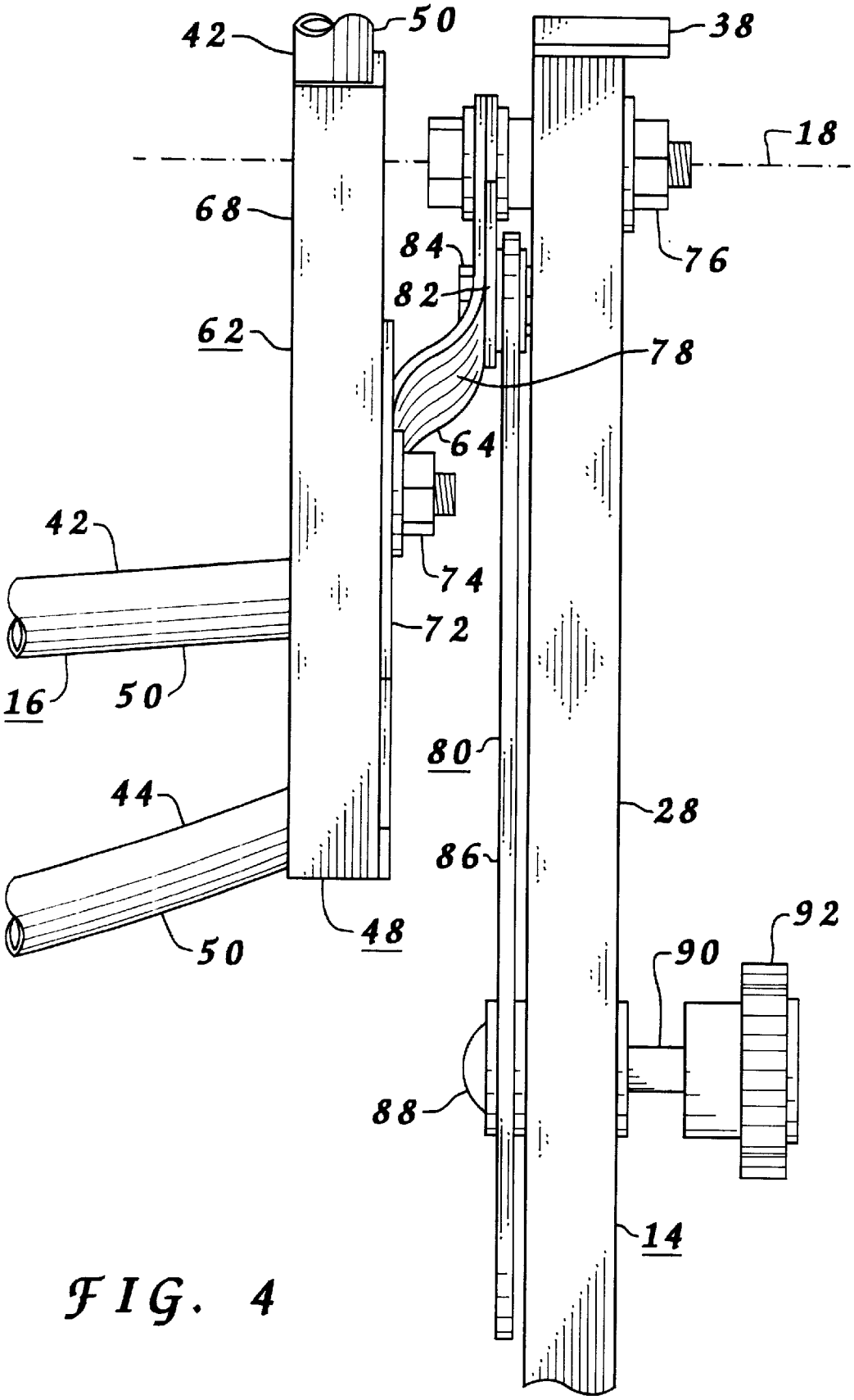
FIG. 4 is a sectional rear elevational view of the portion of the frame assembly shown in FIG. 3*b* with the addition of an operator control member installed thereon.

Each coupling assembly 48, see FIG. 2 through FIG. 4, comprises a support assembly 62 and a seat frame mounting member 64. Support assembly 62 further comprises a seat contacting member 66, a back contacting member 68 and a linking member 70. Preferably, back contacting member 68 and seat contacting member 66 each have two (2) intersecting surfaces as best exampled by an angle iron. Preferably, linking member 70 is a single flat bar of equal thickness as the abutting surfaces of back contacting member 68 and seat contacting member 66. A back pivotal coupling member 72, to provide the desired pivotal mounting of back support frame 42, is attached to the outer side of back contacting member 68 and the outer side of linking member 70. Back support frame 42 is pivotally attached to each of the opposing back pivotal coupling member 72 by a pivotal connection 74. Seat frame mounting member 64 is similarly attached to the outer side of seat contacting member 66 and the outer side of linking member 70. Opposing coupling assemblies 48 are each pivotally attached to respective opposing coupling braces 28 of base frame 14 at pivotal axis 18 utilizing a pivotal connection 76. Seat frame mounting member 64 has offset means in a preferred form of an offset bend 78, see FIG. 4, to provide for adequate clearance of the various components during pivotal movement through a range of motion.

Pivotal axis 18 traverses base frame 14 and traverses seat frame 16 for pivotal movement of seat frame 16 relative to base frame 14. It is a requirement that the user be capable of locking seat frame 16 at a desired angular orientation relative to base frame 14. This may be provided for by having a finite number of locking positions as exampled by various set positions therealong. Preferably the user may select from an infinite number of locking positions within the range of pivotal motion.

There are two (2) general methods of providing for of the seat frame of the reclining chair assembly at the desired angular orientation relative to the base frame of the reclining chair assembly. Various structures may be employed to fulfill the first general method of locking the seat frame relative to the base frame. Under the first general method a coupling member is positioned between an anchor point and a pivotal point where the two (2) points each have a unique spacing from the pivotal axis of the reclining chair assembly. These points are each respectively positioned on the opposing base frame and seat frame. These points have a variable spacing during pivotal movement of the seat frame relative to the base frame. Locking of this spacing between these points provide for locking of the seat frame relative to the base frame. The actual guiding component of the coupling member between these two (2) points may be linearly aligned or have a curvature thereto. The guiding component further may comprise various guiding structures thereon. Various structures may be employed to fulfill the second general method of locking the seat frame relative to the base frame. Under the second general method an arced guide component is positioned on the seat frame wherein all operational points along the guide component have an identical spacing from the pivotal axis of the reclining chair assembly. In this embodiment the pivotal axis becomes the pivotal point of the brake assembly. Therefore, the pivotal point and the anchor point retain a stationary spacing during the pivotal movement of the seat frame relative to the base frame. A locking assembly fixedly positioned on the base frame to slidably engage the guide component and selectively anchor the seat frame relative to the base frame.

Without regard for the method of locking the seat frame relative to the base frame, there exist two (2) methods of manipulating the movement thereabout. The first of these methods involve providing structures which are manually manipulated by the user. Normally this will involve a gripping device which is either displaced between opposing operational positions, as exampled by a lever, or a rotational device which is rotated, as exampled by a knob. The second of these methods involve providing structures which are powered to provide for the movement within the range of pivotal motion. This is exampled by a motor which is activated by a switch. Utilizing this method the power transfer device may act as the brake assembly in the absence of additional locking means.

There exist several locational position possibilities for the placement of a brake assembly on the reclining chair assembly. A first possibility involves a single assembly positioned in close proximity to one (1) of the opposing sides of the reclining chair assembly, as depicted in the embodiment shown in the various views. A second possibility involves opposing assemblies each positioned in close proximity to one (1) of the opposing sides of the reclining chair assembly. A third possibility involves a single assembly centrally positioned on the reclining chair assembly. Any of these locational position possibilities may be employed with the present invention. The centrally positioned possibility is a particularly expedient choice when a power transfer device is employed, even in the absence of a brake assembly.

FIG. 2 through FIG. 4 depict a first embodiment of a brake assembly 80 comprised of an extension member 82, a pivotal connection 84, a coupling member 86, a locking assembly 88, see FIG. 4, a linking shaft 90 and an operator control member 92, see FIG. 2 and FIG. 4. Extension member 82 is rigidly attached to seat frame mounting member 64 to move therewith during pivotal motion of seat frame 16 relative to base frame 14 about pivotal axis 18. Pivotal connection 84 attaches extension member 82 to coupling member 86 wherein coupling member 86 may pivotally move relative to extension member 82. Coupling member 86 has therein an engagement slot 94 which slidably receives linking shaft 90 therein. Linking shaft 90 is fixedly positioned on base frame 14. Operator control member 92 adjustably engages locking assembly 88 via linking shaft 90 to provide for selective tightening of locking assembly 88 about coupling member 86. Operator control member 92 is positioned on base frame 14 in a position conveniently reachable by the user of reclining chair assembly 10 during usage. As clearly depicted in FIG. 4, operator control member 92 may be adjusted to selectively allow movement of coupling member 86 relative to base frame 14 or restrict coupling member 86 relative to base frame 14 utilizing a binding engagement. When adjusted to allow movement of coupling member 86 seat frame 16 may be pivotally moved about pivotal axis 18 relative to base frame 14. When adjusted to restrict movement of coupling member 86, seat frame 16 is restricted relative to base frame 14. In this embodiment the pivotal point, pivotal connection 84, is positioned on seat frame 16 and the anchor point, operator control member 92, linking shaft 90 and locking assembly 88, is positioned on base frame 14.

Figure 5A:
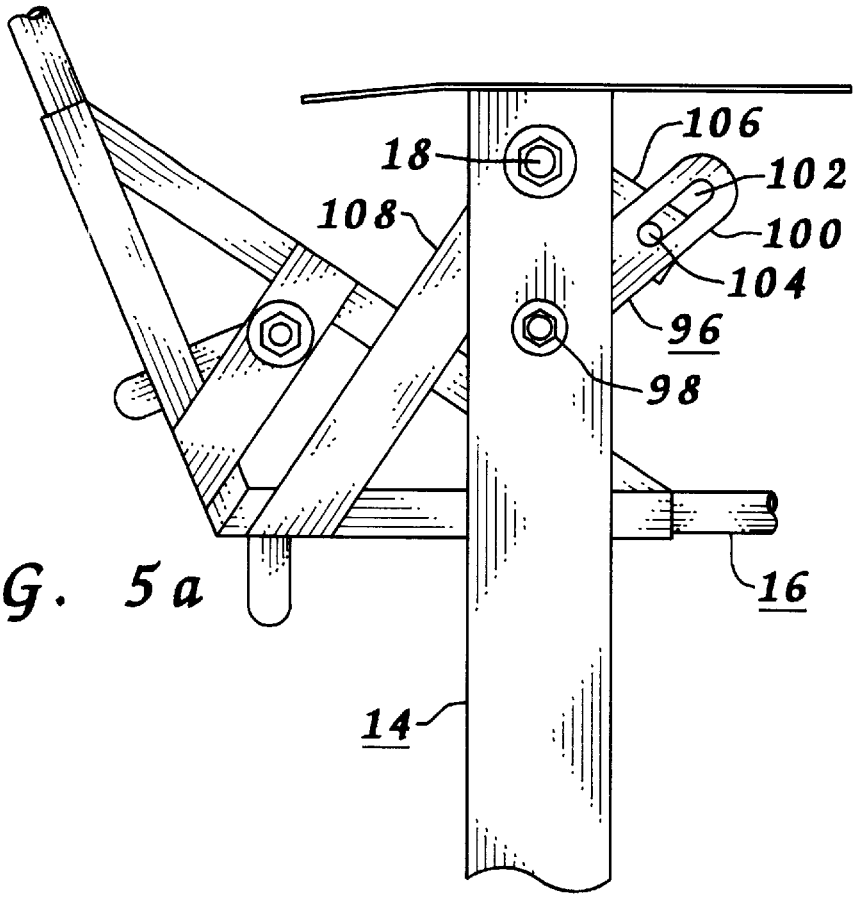
FIG. 5*a* and FIG. 5*b* are sectional side elevational views of another embodiment of a brake assembly.
Figure 5B:
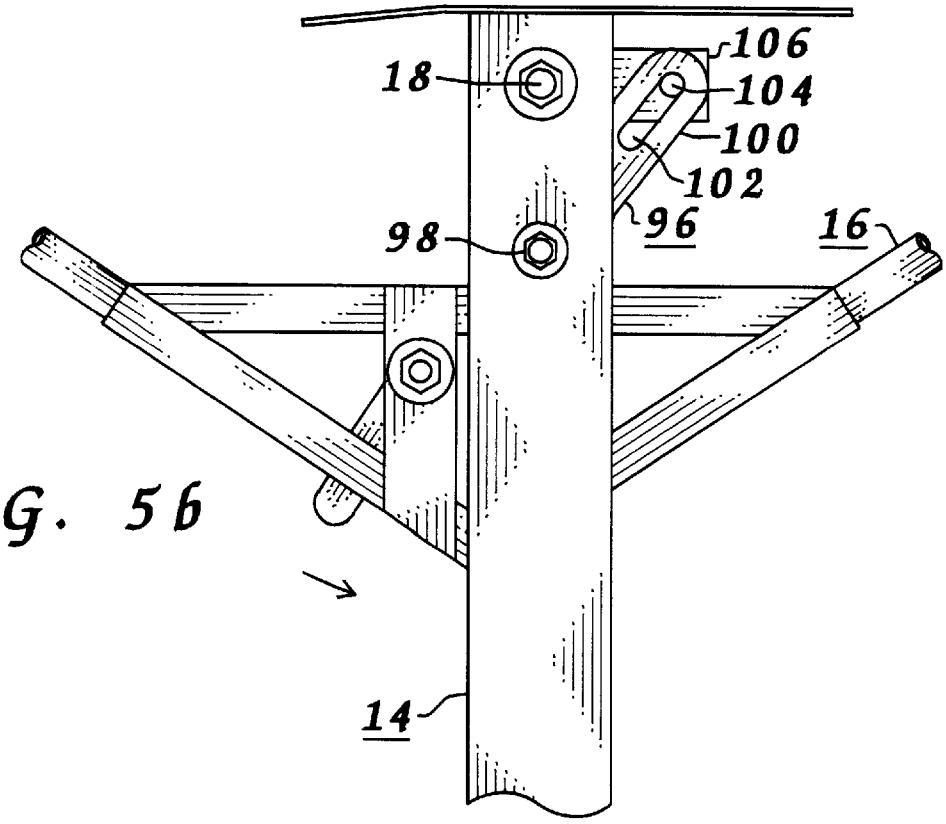

In a second embodiment of a brake assembly 96, see FIG. 5*a* and FIG. 5*b*, the pivotal point is positioned on base frame 14 while the anchor point is positioned on seat frame 16. A pivotal connection 98 is fixedly positioned on base frame 14. A coupling member 100 is pivotally attached to pivotal connection 98. Coupling member 100 has positioned therein an engagement slot 102 which slidably receives a linking shaft 104. Linking shaft 104 is positioned on an extension member 106 to be spaced from pivotal axis 18. Extension member 106 attaches to a seat frame mounting member 108, and therefore moves therewith during movement of seat frame 16 about pivotal axis 18. In the embodiment depicted seat frame mounting member 108 must utilize a different offset means than that disclosed for the previous embodiment in order to provide adequate clearance during movement of seat frame 16 relative to base frame 14. An operator control member, as previously disclosed and not shown in these views, would engage linking shaft 104 to cooperate with a locking assembly, also not shown in these views, to selectively allow or prevent movement of coupling member 100 relative to linking shaft 104. In this embodiment linking shaft 104, and any attached operator control member, will move relative to base frame 14. Therefore, it is necessary to provide for a slot within a side cover plate, not shown in these views and more fully disclosed elsewhere herein, to allow for such movement.

Figure 6A:
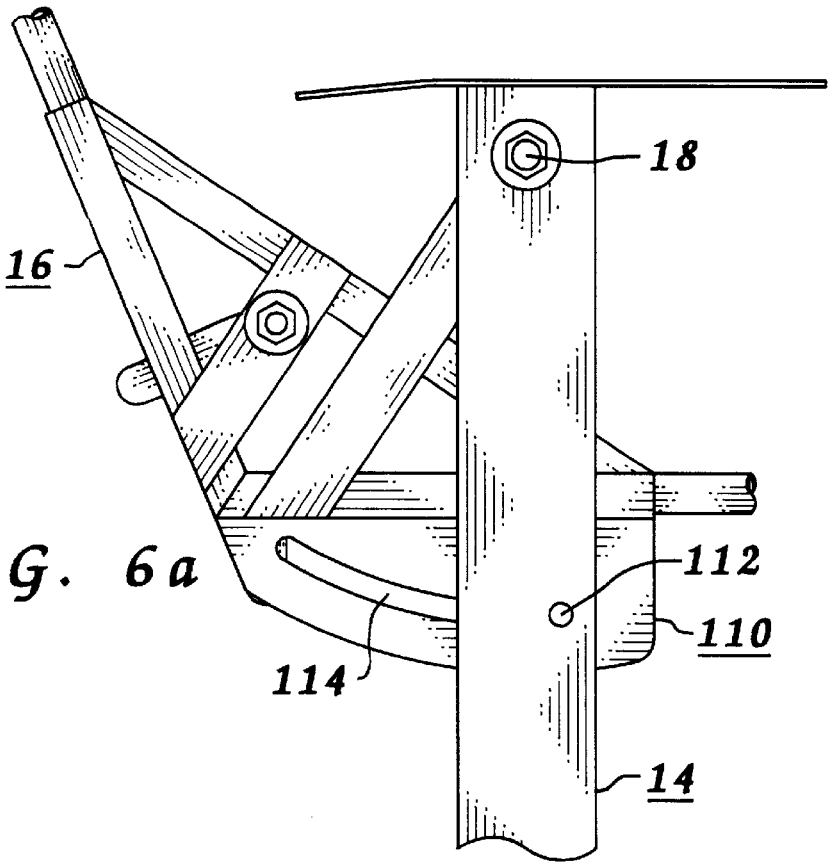
FIG. 6*a* and FIG. 6*b* are sectional side elevational views of yet another embodiment of a brake assembly.
Figure 6B:
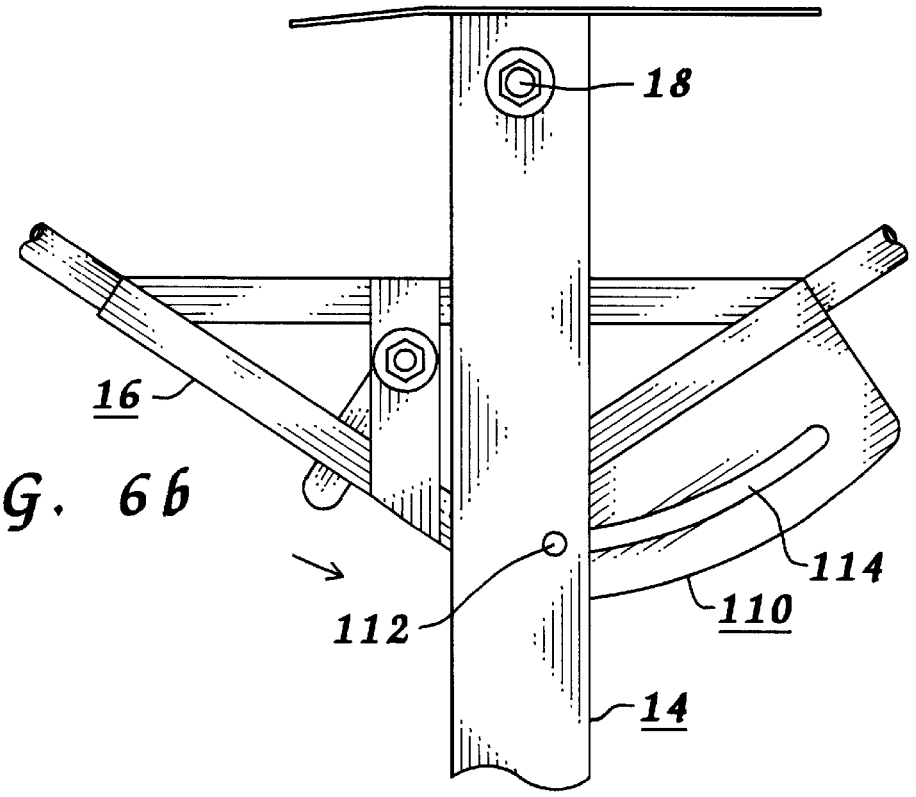

In a third embodiment of a brake assembly 110, see FIG. 6*a* and FIG. 6*b*, the pivotal point is pivotal axis 18, and therefore common to base frame 14 and seat frame 16, while the anchor point is positioned on base frame 14. In this embodiment, the pivotal point and the anchor point, a linking shaft 112, remain at a constant distance during pivotal movement of seat frame 16 relative to base frame 14. An arced track 114 is positioned on seat frame 16 to move therewith during movement of seat frame 16 about pivotal axis 18. Linking shaft 112 slidably engages arced track 114. An operator control member, as previously disclosed and not shown in these views, would engage linking shaft 90 to cooperate with a locking assembly, also not shown in these views, to selectively allow or prevent movement of arced track 114 relative to linking shaft 112.

FIG. 1*a* through FIG. 4 depict reclining chair assembly 10, or portions thereof, in various positional orientations. FIG. 1*a* and FIG. 3*a* depict folded position 60. FIG. 1*b*, FIG. 2, FIG. 3*b* and FIG. 4 depict an upright position 116. FIG. 1*c* and FIG. 3*c* depict a reclined position 118.

Folded position 60 enables reclining chair assembly 10 to be shipped in a fully assembled condition by significantly reducing the dimensions of a container therefor, not shown. This provides for expanding the potential commercial market for such reclining chairs to include those persons which prefer not to purchase furniture which requires any assembly by the end user.

Reclining chair assembly 10 will have cushion assembly 52, as shown in FIG. 1*a* through FIG. 1*c*, to provide for a contact surface for the user. Preferably, arm rests 40 are padded and covered with a similar, or complementary, material as employed for cushion assembly 52. In a preferred embodiment arm rests 40 are arced as depicted in the various views to enhance user comfort and increase aesthetic appeal of reclining chair assembly.

Lower side cover plates 120 and upper side cover plates 121, see FIG. 1*a* through FIG. 1*c*, are employed to cover and conceal structural elements of reclining chair assembly 10 on each of the opposing sides thereof. Additionally, upper side cover plates 121 may be positioned on the opposing side of each respective arm rest 40 to provide closure of structural elements adjacent the user. Applicable structural elements include those displaceable components of the brake assembly. Lower side cover plates 120 and upper side cover plates 121 have the primary function of concealing structural elements of reclining chair assembly 10 to prevent accidental injury to persons as may result from contact with moving parts of reclining chair assembly 10. A secondary function of lower side cover plates 120 and upper side cover plates 121 are to enhance aesthetic appeal of reclining chair assembly 10. In a preferred embodiment upper cover plates 121 are positioned above side cover plates 120.

When reclining chair assembly 10 has vibratory means, more fully disclosed elsewhere herein, a convenient location for installation of control elements associated therewith is within a respective upper side cover plate 121 and particularly one positioning inside of arm rest 40 adjacent cushion assembly 52.

It is possible to provide for various structures which act as safety features to prevent the seat frame from moving to an unsafe position of recline. Numerous structures may be employed to provide such a safety feature. FIG. 3*c* and FIG. 3*d* depict two (2) of the possible structures which provide these safety features. A first such safety feature resides in positioning an end 122 of engagement slot 94 to engage linking shaft 90 to limit rearward reclining of seat frame 16 relative to base frame 14, see FIG. 3*d*. A second such safety feature resides in positioning arm rest support plate 38, or other components of arm rest 40, see FIG. 1*a* through FIG. 1*c*, to engage coupling member 86 or extension member 82 to limit rearward reclining of seat frame 16 relative to base frame 14, see FIG. 3*d*.

Additionally, it is possible to provide for an adjustable assembly which allows the user to set a limit, selected from a range of limits, on the rearward reclining of seat frame 16 relative to base frame 14. This limit may be established as a result of a desire to limit rearward reclining or to allow repetitive locationing of a select preferred angle of recline following location of that angle of recline by the user.

Various research has identified a link between how children learn and their sonic environment. It has been determined that a child hears even before birth and that pre-natal auditory experience is a critical facet of early childhood development. Research has further shown that for people with learning disabilities and other developmental disorders certain music, particularly Mozart's, can provide an audio "bridge" of sorts, which allows many such people to overcome previously impassable developmental blocks.

In a series of test given in the early 1990's it was revealed that listening to Mozart's music greatly enhanced spatial intelligence, a critical component of IQ, as measured on the famed Stanford-Binet scale. Later studies revealed that young children given basic music instruction out perform their peers who were given computer or other forms of training.

A particularly desirable reclining chair assembly may be provided by placing a vibration creation device within the cushion, or cushions. Such a vibration creation device may involve mechanical creation of the vibration or electronic creation of the vibration. An extremely desirable form of vibration may be created in synch with a music composition while simultaneously allowing the user to audibly enjoy appreciation of the musical composition. This may be provided for by placing a speaker, with suitable housing to allow full function of the speaker including transmission of vibratory sound waves, within the cushion. With this arrangement the user may audibly enjoy the music permeating from the cushion while simultaneously enjoying the rhythmic vibration of the music transferred through the cushion. Speakers may be selectively positioned within the leg cushion, the seat cushion and the back cushion.

Various structures may be employed in speaker design to allow for incorporation of the speaker within a resting surface while providing for audio reception of musical compositions as well as vibrator reception of the musical compositions through the resting surface. A particularly expedient improvement in such speaker design incorporates a vacuum forming of a housing from a sheet material and a vacuum forming of a speaker plate from a sheet material.

The vacuum formed housing would match with the vacuum formed speaker plate and protect the rearward extent of the resultant speaker structure. Due to heat generation from the speaker, preferably a heat dissipating material would be sandwiched between the rearward extent of the speaker and the housing. The vacuum formed speaker plate would contain a circular shaped depression forming speaker ribs. Select areas of material radially disposed within the depression would be removed from the depression to allow free movement of air flow behind the speaker to allow for full vibration of the speaker. A central area of material would be removed from the depression to house the magnetic core of the speaker. The formed depression allows for the free movement of a voice coil and attached piston or diaphragm. With this design the entire structure of the resultant speaker may be formed by vacuum forming from a sheet material.

Speakers may be placed adjacent the head position of the user for stereo reception of the music directly without transmission through any cushion. This arrangement may be employed with or without the vibration creation device within the reclining chair assembly. When such an arrangement is employed mounting of the headrest in close proximity to the speakers may be so mounted for pivotal adjustment to allow the user to locate the most comfortable position specific to the user. Additionally, mounting of the headrest in close proximity to the speakers may be so mounted for elevationally adjustment to allow the user to position the speaker location for the most pleasant listening enjoyment specific to the user.

It is possible to provide for the entire reclining chair assembly to be separated into readily transportable components for convenient transport. This is particularly expedient when the above identified vibration creation device is deployed within the reclining chair assembly and the assembly is utilized by traveling therapist. One example of such separation involves breaking the reclining chair assembly down into three (3) component sets comprising the base frame, the seat frame and the cushion assembly. The base frame may be disassembling as previously disclosed to form one transportable component set suitable for packaging in a first tightly configured case. The back support frame of the seat frame may be folded over to rest adjacent the seat support frame and the leg support frame which forms one transportable component suitable for packaging in a second tightly configured case. The cushion assembly, whether a single cushion or a plurality of cushions, including the vibration creation device if deployed, may be configured to form one transportable component suitable for packaging in a third tightly configured case. These cases then may be readily carried by a person desirous of transporting the reclining chair assembly between locations.

When speakers are present on the reclining chair assembly, when a vibration creation device is installed therein or when both are present it is possible to provide for a surrounding cabinet having side panels and a retractable hood. This arrangement may optionally include speakers in the side panels and/or in the retractable hood facing toward the reclining chair assembly. This arrangement may optionally include a video display panel in the retractable hood facing toward the reclining chair assembly. The side panels may be stationarily positioned relative to the base frame, may be attached to the retractable hood to move therewith or may be independently displaceable from the retractable hood. Preferably, the retractable hood is positioned to pivot clam shell style relative to the head portion of the reclining chair assembly along the longitudinal length of the reclining chair assembly.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A reclining chair assembly comprising:

a) a base frame to provide for contact with a support surface;

b) a seat frame to provide for support of a cushion member, the seat frame having a back support member and a seat support member, the back support member and the seat support member having a fixed relative positional orientation;

c) pivotal connection means to provide for a mounting of the seat frame relative to the base frame, the mounting to provide for a pivotal movement of the seat frame relative to the base frame at a pivotal axis;

d) an anchor point positioned on the reclining chair assembly, the anchor point having a measurement distance from a nearest point on the pivotal axis, the anchor point offset from the pivotal axis of the pivotal movement of the seat frame relative to the base frame;

e) a pivotal point positioned on the reclining chair assembly, the pivotal point having a measurement distance from a nearest point on the pivotal axis, the pivotal point offset from the pivotal axis of the pivotal movement of the seat frame relative to the base frame;

wherein the measurement distance of the anchor point from a nearest point on the pivotal axis is unique from the measurement distance of the pivotal point from a nearest point on the pivotal axis and wherein the anchor point and the pivotal point have a relative spacing therebetween which is a variable distance measurement depending upon an angular positioning of the seat frame relative to the base frame during the pivotal movement at the pivotal axis;

f) a coupling member to provide for a linking between the anchor point and the pivotal point, the coupling member pivotally connected to the reclining chair assembly at the pivotal point;

g) locking means to provide for a securing of the coupling member at the anchor point to provide for a securing of the relative spacing between the anchor point and the pivotal point to control the angular positioning of the seat frame relative to the base frame.

2. The reclining chair assembly defined in claim 1 wherein the pivotal point is positioned on the base frame of the reclining chair assembly.

3. The reclining chair assembly defined in claim 1 wherein the pivotal point is positioned on the seat frame of the reclining chair assembly.

4. The reclining chair assembly defined in claim 1 wherein the anchor point is fixedly positioned on the base frame and wherein the locking means further comprises an operator control member fixedly positioned on the base frame for communication with the anchor point.

5. The reclining chair assembly defined in claim 1 wherein the coupling member further comprises a linearly aligned engagement track and wherein the locking means further provides for a binding engagement of the linearly aligned engagement track of the coupling member to provide for the securing of the relative spacing between the anchor point and the pivotal point.

6. The reclining chair assembly defined in claim 1 wherein the coupling member has a variable angular orientation during the pivotal movement of the seat frame relative to the base frame and wherein the variable angular orientation is generally vertical relative to the support surface.

7. The reclining chair assembly defined in claim 1 wherein the base frame further comprises opposing support extensions, each support extension having an arm rest attached thereto, each arm rest fixedly positioned relative to the base frame throughout a range of motion of the seat frame during the pivotal movement of the seat frame relative to the base frame.

8. A reclining chair assembly comprising:

a) a base frame to provide for contact with a support surface;

b) a seat frame to provide for support of a cushion member, the seat frame having a back support member and a seat support member, the back support member and the seat support member having a fixed relative positional orientation;

c) pivotal connection means to provide for a mounting of the seat frame relative to the base frame, the mounting to provide for a pivotal movement of the seat frame relative to the base frame at a pivotal axis, the pivotal axis penetrating the base frame and the pivotal axis penetrating the seat frame;

d) a brake assembly to provide for an anchoring of the seat frame relative to the base frame, the brake assembly comprising:

1) an engagement member connected to the seat frame, the engagement member connected to the seat frame using a pivotal connection, the pivotal connection offset from the pivotal axis of the pivotal movement of the seat-frame relative to the base frame;

2) a locking member fixedly positioned relative to the base frame and engaging the engagement member, the locking member having a locked state and an unlocked state, the locking member to provide for a securing of the engagement member at a desired position relative to the base frame while the locking member is in the locked state wherein the seat frame is retained at a desired angular orientation relative to the base frame while the locking member is in the locked state.

9. The reclining chair assembly defined in claim 8 wherein the base frame further comprises opposing support extensions, each support extension having an arm rest attached thereto, each arm rest fixedly positioned relative to the base frame throughout a range of motion of the seat frame during the pivotal movement of the seat frame relative to the base frame.

10. The reclining chair assembly defined in claim 8 wherein the engagement member further comprises a linearly aligned engagement track and wherein the locking member further provides for a binding engagement of the linearly aligned engagement track of the engagement member while the locking member is in the locked state to provide for the securing of the engagement member at the desired position relative to the base frame.

11. The reclining chair assembly defined in claim 8 wherein the engagement member is connected to the seat frame using a pivotal connection and wherein the engagement member has a variable angular orientation during the pivotal movement of the seat frame relative to the base frame and wherein the variable angular orientation is generally vertical relative to the support surface.

12. The reclining chair assembly defined in claim 8 wherein the pivotal connection of the engagement member further has a measurement distance from a nearest point on the pivotal axis and wherein the locking member has a measurement distance from a nearest point on the pivotal axis, the locking member offset from the pivotal axis of the pivotal movement of the seat frame relative to the base frame, wherein the measurement distance of the pivotal connection from the nearest point on the pivotal axis is unique from the measurement distance of the locking member from the nearest point on the pivotal axis and wherein the pivotal connection and the locking member have a relative spacing therebetween which is a variable distance measurement depending upon an angular positioning of the seat frame relative to the base frame during the pivotal movement at the pivotal axis.

* * * * *